United States Patent [19]

Lewis et al.

[11] Patent Number: 4,548,545

[45] Date of Patent: Oct. 22, 1985

[54] CENTRIFUGAL PUMP WITH DEAERATION CHAMBER

[75] Inventors: Kenneth D. Lewis, Monument, Colo.; Timothy A. Potts, Darien, Conn.

[73] Assignee: Dorr-Oliver Incorporated, Stamford, Conn.

[21] Appl. No.: 481,806

[22] Filed: Apr. 4, 1983

[51] Int. Cl.[4] ..... F04D 17/08; F04D 29/44

[52] U.S. Cl. ..... 415/90; 415/209; 415/DIG. 7

[58] Field of Search ..... 415/90, 89, 53 R, 120, 415/209, DIG. 7

[56] References Cited

U.S. PATENT DOCUMENTS

| | | | |
|---|---|---|---|
| 2,423,634 | 7/1947 | Berliner | 415/53 UX |
| 2,922,375 | 1/1960 | Edwards | 415/53 UX |
| 3,093,084 | 6/1963 | Derderian | 415/209 UX |
| 3,180,268 | 4/1965 | Willis et al. | 415/89 X |
| 3,227,089 | 1/1966 | Haarhuis | 415/53 UX |
| 3,273,865 | 9/1966 | White | 415/90 X |
| 3,307,485 | 3/1967 | Logue | 415/120 X |
| 3,936,214 | 2/1976 | Zupanick | 415/89 |
| 4,403,911 | 9/1983 | Possell | 415/90 |

FOREIGN PATENT DOCUMENTS

| | | | |
|---|---|---|---|
| 543032 | 8/1922 | France | 415/120 |

*Primary Examiner*—Robert E. Garrett
*Assistant Examiner*—Joseph M. Pitko
*Attorney, Agent, or Firm*—Burtsell J. Kearns

[57] ABSTRACT

A centrifugal pump comprising a cylindrical outer housing having a fluid feed conduit concentrically arranged therein with the outer wall portions thereof spaced from the inner walls of this outer housing to provide a fluid discharge outlet therebetween and a stator secured to one end of said housing having fluid discharge channels open to said fluid discharge outlet and a rotor casing encompassing said stator rotatable relative thereto wherein air bubbles in the fluid feed are sheared in a deaerating chamber adjacent said stator and vent means provided for discharging air from the rotor casing.

8 Claims, 5 Drawing Figures

CENTRIFUGAL PUMP WITH DEAERATION CHAMBER

BACKGROUND OF THE INVENTION

The present invention relates to new and useful improvements in fluid pumps and more particularly to centrifugal pumps.

Centripetal pumps are well known and generally include a rotatable outer rotor housing and a stator comprising a stationary inner pitot tube within the rotatable housing. Fluid is pumped into the rotating housing and the velocity of the fluid is increased and the centrifugal forces induced by the rotating housing directs the fluid to the extremities thereof to be discharged through the pitot tube.

Typical of these prior art devices are such as that disclosed in such patents as U.S. Pat. No. 3,180,268 to Willus and U.S. Pat. No. 3,936,214 to Zupanick. In the Willus patent there is disclosed a high speed dynamic fluid pump consisting of an outer rotary housing which rotates around an inner stationary pitot. The fluid pump pulls the fluid into the pump chamber and then exhausts the fluid outwardly in the same direction and includes means for bleeding air from the pumpable fluid. The Zupanick patent on the other hand discloses a two-phase rotary pump consisting of an outer rotary member and a stationary inner pitot. The pump of this patent pulls two-phase fluids into a pump chamber through a suitable conduit and centrifugal forces are developed by rotary member. A dense fluid is pumped out of the pump chamber through one orifice and a lighter phase fluid is pumped through a second orifice.

Although these known type pumps utilizing rotary pump impellers exteriorally arranged to a stator element may be acceptable for use in certain applications they have not been proven readily adaptable for use in handling fluids having a high foam or air content which is fed to the pump in relatively high volumes. Typical of such fluids are filtrates developed in paper and pulp mill processes in brownstock washing and deckering steps.

It is an object of the present invention to provide a novel centrifugal pump.

Another object is to provide a centrifugal pump having novel means for breaking high volumes of foam and deaerating liquid feed streams and further capable of pumping intermittent flows.

It is still a further object to provide a novel compact, high volume positive displacement centrifugal pump having a constant discharge independent of downstream pressure.

SUMMARY OF THE INVENTION

The present invention contemplates a novel centrifugal pump for processing high volume fluid flows and in particular fluids having a high foam or air content. In one embodiment the pump comprises a housing containing concentrically arranged feed and outlet conduits having a stator mounted on one end thereof. The stator is disposed in a rotatable rotor casing which is provided with an impeller plate aligned with the outlet of the feed conduit. Upon rotation of the impeller fluid is caused to be fed by the impeller vanes to reception channels provided between adjacent vanes of the stator element for discharge to the outlet conduit. Air bubbles present in the foamy feed liquid are broken under the shear action of the impeller vanes and high gravities as the fluid moves to the periphery of the rotor casing. Venting means are provided in the walls of the rotor casing for discharging the air freed from the feed fluid.

The above and other objects of the present invention will appear more fully hereinafter from a consideration of the detailed description which follows taken together with the accompanying drawings wherein one embodiment is illustrated.

IN THE DRAWINGS

DETAILED DESCRIPTION

Figure 1:
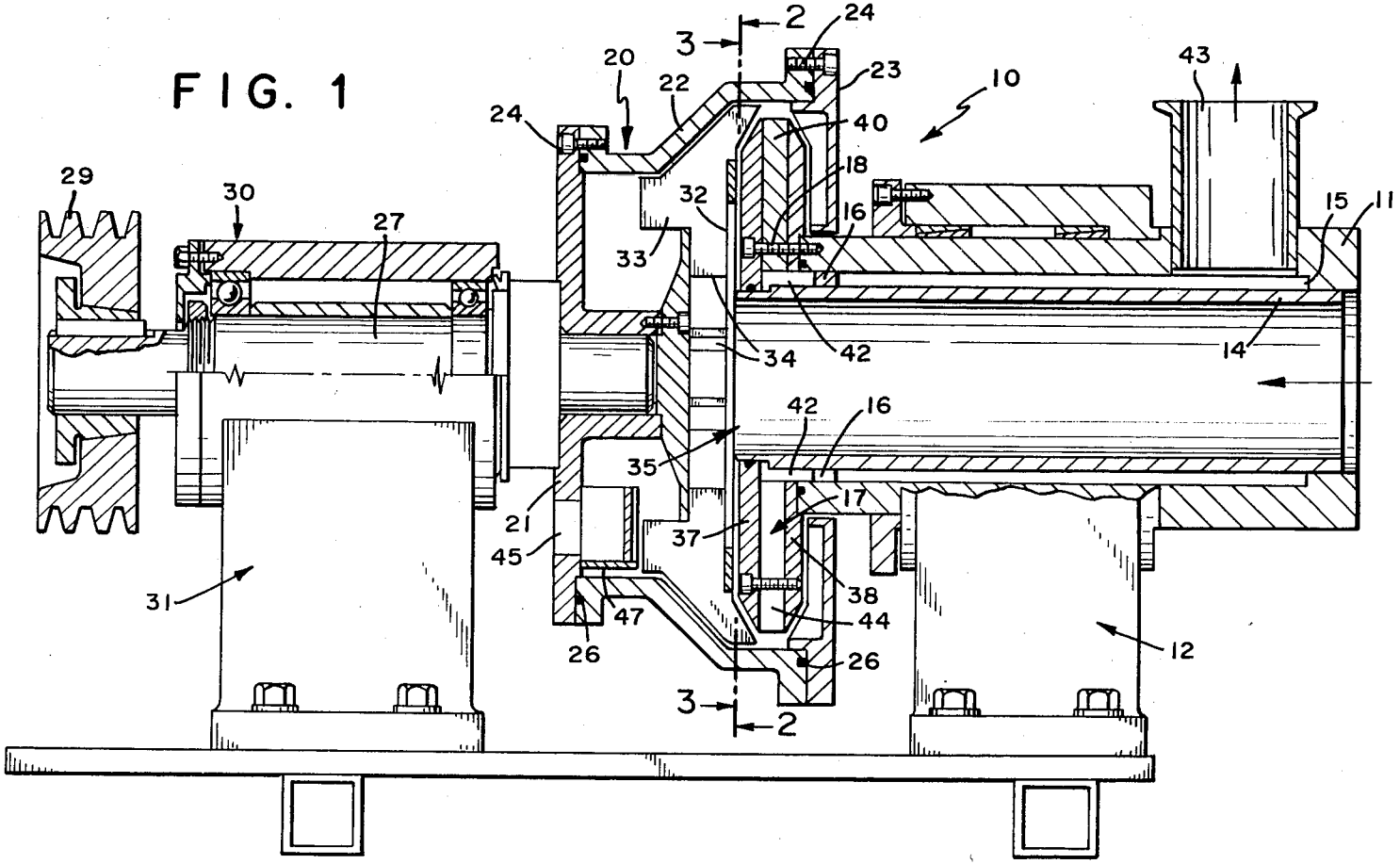
FIG. 1 is a cross sectional elevational view of a centripetal pump embodying the present invention.

Referring now to the drawings for a more detailed description of the present invention, a centrifugal pump incorporating one embodiment thereof is generally indicated by the reference numeral 10 in FIG. 1.

Pump 10 includes an outer cylindrical housing 11 mounted on a support stand 12. A cylindrical feed conduit tube 14 extends through housing 11 and is concentrically located within a second or outer tubular conduit 15 formed in housing 11 which is spaced from the walls of tube 14 by suitable spacing members 16.

A stator element 17 is secured to housing 11 by suitable fastening means such as screws 18 (one of which is shown in FIG. 1). Stator 17 is disposed within a circular shaped rotor casing 20 which is comprised of a hub base portion 21, an intermediate sidewall section 22 and endwall 23 which are interconnected by screw fasteners 24. Seals 26 are provided between adjacent edge portions of sidewall 22 and hub 21 and also between edges of sidewall 22 and endwall 23 to maintain the sections of casing 20 in fluid type relationship.

Means for rotating rotor casing 20 about stator 17 include drive shaft 27 having one end journalled in hub 21 and its opposite end connected to a drive sheave 29. Drive sheave 29 is connectable to a motor drive by a suitable drive belt (not shown). The intermediate portion of drive shaft 27 is supported in a bearing casing generally indicated by the reference numeral 30 which is mounted on a second support stand 31 which is spaced from support stand 12.

Figure 2:
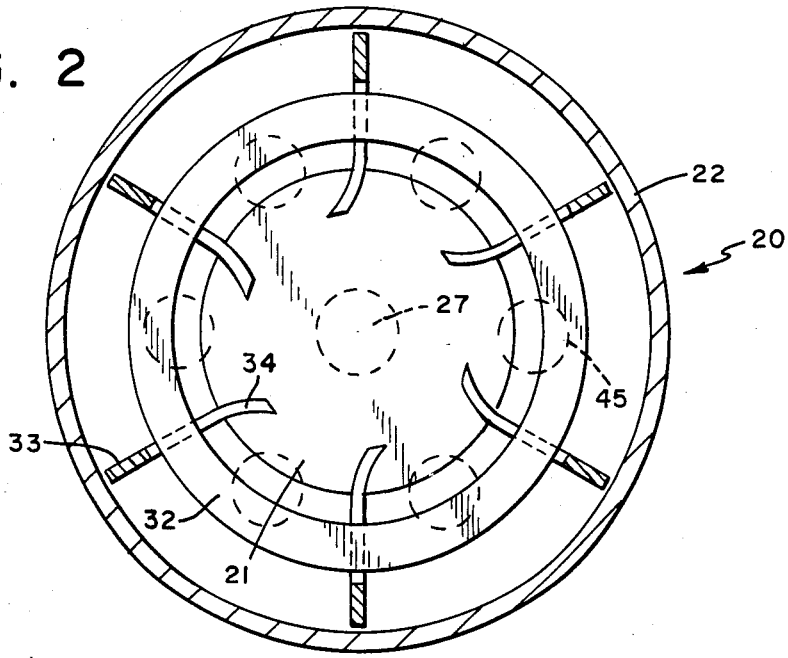
FIG. 2 is a sectional view taken on line 2—2 of FIG. 1.

An impeller plate 32 is secured to hub 21 of rotor 20. Distributor vanes 33 (FIGS. 1 and 2) having curved end portions 34 are provided on the outer wall surface of impeller 32 with the center of impeller plate 32 concentrically arranged relative to a feed discharge 35 of the pump feed conduit 14.

Figure 3:
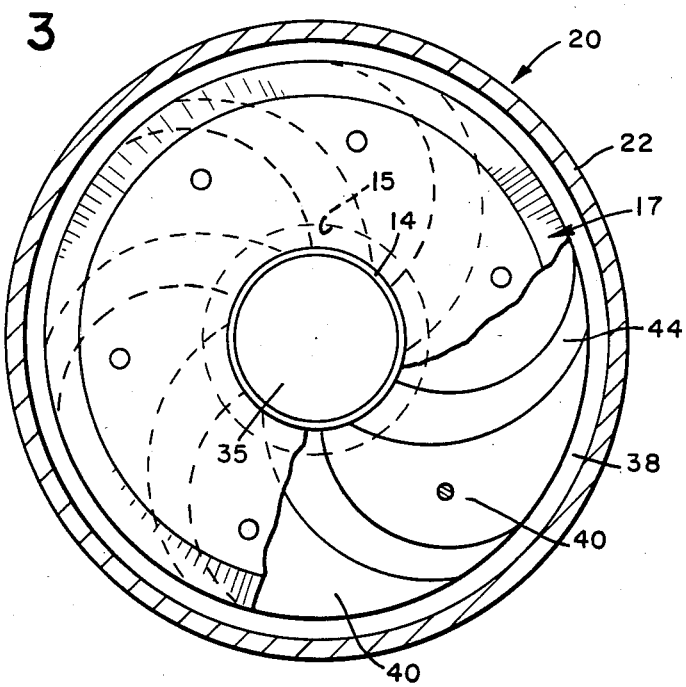
FIG. 3 is a sectional view taken on the line 3—3 of FIG. 1.

Stator 17 is also concentrically positioned relative to impeller plate 32 and is comprised of spaced circular walls 37–38 which sandwich therebetween scoop shaped directing vanes 40 (FIG. 3). Spaced passageways or channels 44 are provided in stator 17 between adjacent vanes 40 and which channel 44 are opened at one end to outlet passage 42 in outlet feed tube 15 which leads to a discharge pipe 43 in pump housing 11. The opposite end openings of channel 44 are open to the periphery of rotor vanes 33 to receive fluid therefrom.

As mentioned it is a feature of this invention to provide means for breaking foam and aerating liquid feed streams. To this end a plurality of vent openings 45 (one shown in FIG. 1) are provided in the walls of hub base portion 21 within a fluid receiving and deaeration chamber providing in the area between base portion 21 and stator 17. Openings 45 are spaced from the rear edges of impeller vanes 31 by wall enclosures 47 which prevent liquid from escaping casing 20 but are open at their tops (FIG. 1) to permit air to be discharged through vents 45.

In operation of centrifugal pump 10 upon rotation of drive shaft 27 the rotor casing 20 together with impeller 32 are caused to be rotated. A feed stream enters feed tube 14 and is discharged through discharge outlet 35 against impeller plate 32. The liquid impinges against the rotating impeller plate vanes 33 which accelerate the liquid to the periphery of the rotor housing whereat scoop like vanes 40 of stator 17 pick up the fluid and provide the pumping action necessary to overcome downstream pressure and move the fluid through channels 44 to discharge outlet openings 42 in conduit 15. Air bubbles present in the feed liquor are broken under the shear action of vanes 33 and the high gravities as the fluid moves into rotor casing 20 periphery. Air is discharged through vents 45 provided in rotor casing 20.

Figure 4:
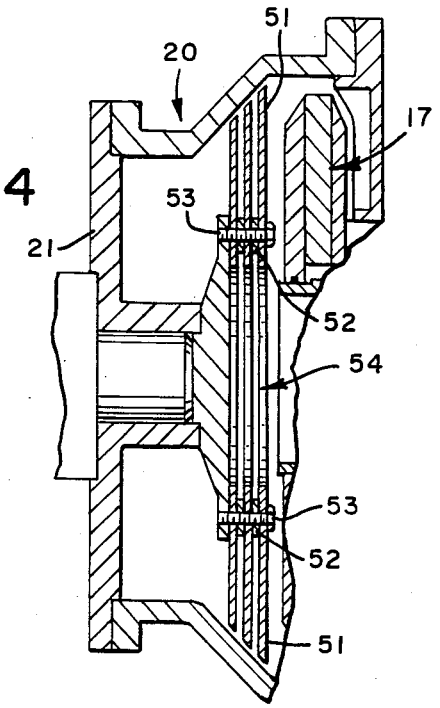
FIG. 4 is an alternate embodiment of the invention having an impeller comprising a plurality of disc members.
Figure 5:
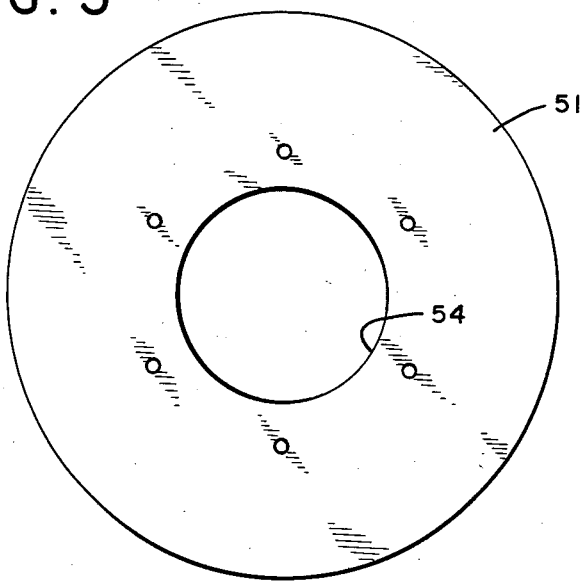
FIG. 5 shows one disc member used in the FIG. 4 embodiment.

Another embodiment of an impeller for rotor casing 20 is shown in FIGS. 4 and 5 and comprises an impeller 50 comprised of a plurality of discs 51 of decreasingly lessening diameter. Discs 51 are spaced one from the other by spacing members 52 and are interconnected to hub portion 21 of rotor casing 20 by threaded fastener means 53. Concentric openings 54 are provided in the aligned discs 51 attached to hub 21 at feed tube 14.

In operation of this embodiment the fluid entering feed tube 14 enters openings 54 and discs 51 and impinges against the surface of hub 21 whereby the liquid is dispersed to the outer periphery of discs 51 whereat it is accellerated and a stable air-liquid interface or boundary is created to minimize turbulence. The foam breaking ability of pump 10 is enhanced as the increased surface contact of the liquid passing between discs 51 cause foam bubbles to be stretched and broken therebetween.

It will be apparent from the foregoing description the novel centrifugal pump has many advantages in use. One advantage among others is that the compact pump housing and arrangement of parts allows for a high volume feed flow adaptable for handling liquids containing a high percentage of air bubbles such as foamy liquor found in brownstock filtration fluids in paper and pulp processes.

Although two embodiments of the present invention has been illustrated and described in detail it is to be expressly understood that the invention is not limited thereto. Various changes can be made in the design and arrangement of parts without departing from the spirit and scope of the invention as the same will now be understood by those skilled in the art.

We claim:

1. A centrifugal fluid pump comprising, (a) a cylindrical shaped outer housing, (b) fluid feed means comprising a tubular conduit member concentrically arranged within said cylindrical outer housing and having outer walls spaced from the inner wall surface of said outer housing to provide a fluid outlet passage therebetween, (c) a stator element comprised of a pair of spaced interconnected cylindrical plates secured to one end of said outer housing, (d) a rotor casing having a base portion spaced from said stator and having peripheral sidewall portions encompassing the periphery of said stator, (e) a deaeration chamber provided in said rotor casing between said base portion and said stator, (f) an impeller secured to an axial hub of said rotor base portion in alignment with the discharge outlet of said fluid feed conduit member to said deaeration chamber, and spaced a predetermined distance from said stator and fluid discharge outlet to provide a liquid shearing zone within said deaeration chamber, (g) a plurality of radially extending fluid receiving channel vanes in said stator between said stator plates open at their inner ends thereof to said fluid outlet passage and at the outer ends to the periphery of said rotor impeller, (h) vent outlets in said rotor base portion, and (i) drive means connected to said rotor casing operable to rotate said rotor casing and impeller for discharging fluid from said deaeration chamber to said stator fluid receiving channel vanes while air bubbles separated from said fluid by said impeller are sheared in said shearing zone and air discharged through said vent outlets.

2. The pump of claim 1 wherein said impeller comprises a plate member secured to said axial hub of said rotor base portion and wherein fluid distributing means comprising spaced vane members are provided on the surface of said plates for rotation therewith with said deaeration chamber.

3. The pump of claim 2 wherein said vane members have inner curved end portions.

4. The pump of claim 1 wherein said impeller comprises a plurality of spaced and parallel discs mounted in spaced concentric relationship on said axial hub of said rotor base portion for rotation therewith with said deaeration chamber.

5. The pump of either claim 2 or 4 wherein said fluid directing means of said stator element comprise spaced vane members within said stator.

6. The pump of claim 4 wherein aligned openings are provided in said discs for receiving fluid from said fluid feed conduit.

7. The pump of claim 6 wherein said stator vanes are curved and said channels narrow in width as they approach said outlet conduit.

8. The pump of claim 1 wherein said drive means for said rotatable casing comprise a drive shaft having one end secured to said rotor casing and the opposite end to a drive source, the intermediate portion of said shaft being mounted bearing housing having support means spaced from said rotor casing.

* * * * *